US008777684B2

(12) United States Patent
Grutta et al.

(10) Patent No.: US 8,777,684 B2
(45) Date of Patent: Jul. 15, 2014

(54) SYSTEMS AND METHODS FOR INFLATABLE AVALANCHE PROTECTION WITH SYSTEM DIAGNOSTIC

(75) Inventors: James Thomas Grutta, Draper, UT (US); Nathan Kuder, Park City, UT (US); Peter Thomas Gompert, Huntsville, UT (US); Derick Noffsinger, Salt Lake City, UT (US); Robert John Horacek, Park City, UT (US); Joseph Benjamin Walker, Draper, UT (US); David Kuhlmann Blackwell, Highland, UT (US)

(73) Assignee: Black Diamond Equipment, Ltd, Salt Lake City, UT (US)

( * ) Notice: Subject to any disclaimer, the term of this patent is extended or adjusted under 35 U.S.C. 154(b) by 61 days.

(21) Appl. No.: 13/594,267

(22) Filed: Aug. 24, 2012

(65) Prior Publication Data

US 2013/0149924 A1 Jun. 13, 2013

Related U.S. Application Data

(63) Continuation-in-part of application No. 13/324,840, filed on Dec. 13, 2011.

(51) Int. Cl.
*B63C 9/18* (2006.01)

(52) U.S. Cl.
USPC ..... 441/80; 116/210

(58) Field of Classification Search
USPC ..... 441/80, 88, 92, 96, 129; 116/209, 210; 182/3; 137/114, 888, 895; 224/153, 224/155, 580, 582; 2/456
See application file for complete search history.

(56) References Cited

U.S. PATENT DOCUMENTS 4,920,674 A * 5/1990 Shaeffer ..... 40/412
7,270,077 B2 * 9/2007 Beck ..... 116/210

* cited by examiner

*Primary Examiner* — Lars A Olson
(74) *Attorney, Agent, or Firm* — Trent Baker; Baker & Associates PLLC

(57) ABSTRACT

One embodiment of the present invention relates to an avalanche safety system including an inflatable chamber, activation system, inflation system, diagnostic system and a harness. The inflatable chamber is a three-dimensionally, partially enclosed region having an inflated state and a compressed state. The inflated state may form a particular three dimensional shape configured to protect the user from burial and provide flotation during an avalanche. The activation system is configured to receive a user-triggered action to activate the system. The inflation system may include an air intake, battery, fan, and internal airway channel. The inflation system is configured to transmit ambient air into the inflatable chamber. The diagnostic system includes a at least one sensor configured to measure a parameter corresponding to the inflation system and a display configured to visually, audibly, and/or tactilely display the parameter.

18 Claims, 12 Drawing Sheets

SYSTEMS AND METHODS FOR INFLATABLE AVALANCHE PROTECTION WITH SYSTEM DIAGNOSTIC

RELATED APPLICATIONS

This is a continuation-in-part of application Ser. No. 13/324,840 filed on Dec. 13, 2011, and titled "SYSTEMS AND METHODS FOR INFLATABLE AVALANCHE PROTECTION". Priority is hereby claimed to all material disclosed in this pending parent case.

FIELD OF THE INVENTION

The invention generally relates to inflatable avalanche safety systems and methods of operation. In particular, the present invention relates to systems and methods for efficient inflation of an avalanche safety chamber.

BACKGROUND OF THE INVENTION

One type of emergency life-preserving equipment is an inflatable safety system configured to inflate a chamber in response to an emergency event such as an impact or a potential impact. For example, automobile driver inflatable safety systems are designed to automatically inflate a chamber over the steering wheel in response to an impact between the automobile and another object so as to protect the driver from forceful impact with interior structures of the automobile. Likewise, avalanche inflatable safety systems are designed to manually inflate a chamber adjacent to the user in response to the user's triggering of an inflation mechanism. Inflatable safety systems generally include an inflatable chamber, an activation system, and an inflation system. The inflatable chamber is designed to expand from a compressed state to an inflated state so as to cushion the user or dampen potential impact. The inflatable chamber may also be used to encourage the user to elevate over a particular surface. The elevation of the inflatable chamber is achieved by the concept of inverse segregation, in which larger volume particles are sorted towards the top of a suspension of various sized particles in motion. The activation system enables manual or automatic activation of the inflation system. The inflation system transmits a fluid such as a gas into the inflatable chamber, thus increasing the internal pressure within the inflatable chamber and thereby transitioning the inflatable chamber from the compressed state to the inflated state.

Unfortunately, conventional inflatable avalanche safety systems fail to provide an efficient safety system. First, conventional systems are limited to single use in-field operation. The portable compressed gas canisters used in the conventional systems are generally configured to only contain a sufficient volume for a single deployment and therefore must be completely replaced to rearm the system. Therefore, if a user inadvertently deploys the system, it cannot be rearmed without replacing the canister. Second, conventional systems include one or more combustible or pressurized components that are not permitted on airplanes and helicopters, thus limiting the systems' use in travel situations. Third, conventional avalanche inflatable systems require a complex rearming procedure that includes replacing at least one component to enable repeated use. This may compromise user safety or system operation if performed incorrectly.

Another problem with conventional inflatable avalanche safety systems is the inability for a user to intuitively identify the status of the system without internal inspection. For example, an avalanche safety system may be inoperable thereby unable to provide any safety to the user. If a canister-based avalanche safety system is deployed and partially rearmed in the manner that conceals the inflatable chamber, the user may mistakenly assume the system is rearmed and capable of inflating the inflatable chamber. Likewise, if an internal critical portion of an inflatable avalanche safety system becomes detached or worn as a result wear, a user may also mistakenly assume the system is capable of protection during an avalanche.

Therefore, there is a need in the industry for an efficient and reliable inflatable avalanche safety system that overcomes the problems with conventional systems.

SUMMARY OF THE INVENTION

The present invention generally relates to inflatable avalanche safety systems and methods of operation. One embodiment of the present invention relates to an avalanche safety system including an inflatable chamber, activation system, inflation system, a diagnostic system, and a harness. The inflatable chamber is a three-dimensionally, partially enclosed region having an inflated state and a compressed state. The inflated state may form a particular three dimensional shape configured to protect the user from impact and/or provide inverse segregation during an avalanche. The activation system is configured to receive a user-triggered action to activate the system. The inflation system may include an air intake, battery, fan, and internal airway channel. The inflation system is configured to transmit ambient air into the inflatable chamber. The diagnostic system includes at least one sensor configured to measure a parameter corresponding to the inflation system and a display configured to visually, audibly, and/or tactilely display the parameter. The harness may be a backpack that enables a user to transport the system while engaging in activities that may be exposed to avalanche risk. The harness may include hip straps, shoulder straps, internal compartments, etc.

Embodiments of the present invention represent a significant advance in the field of avalanche safety systems. Embodiments of the present invention avoid the limitations of conventional avalanche safety systems by using ambient air rather than a canister of compressed gas. The use of ambient air avoids the explosive dangers associated with compressed gas canisters and thereby is legal for air transportation. Likewise, ambient air is unlimited and therefore enables multiple inflations and/or inadvertent deployments. Finally, the procedure to rearm the system is simplified to enable intuitive user operation.

In addition, embodiments of the present invention overcome the lack of intuitive feedback as to the status and/or capability of the system to provide avalanche protection. Embodiments of the present invention include a diagnostic system configured to provide the user visual, audible, and/or tactile information corresponding to the status and configuration of the inflation system and/or the activation system. Therefore, a user may confirm the system is capable of providing avalanche protection prior to engaging in activities that include risk of avalanche danger.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. In the Figures, the physical dimensions may be exaggerated for clarity. The same reference numerals in different drawings represent the same element, and thus their descriptions will be omitted.

DETAILED DESCRIPTION OF THE INVENTION

The present invention generally relates to inflatable avalanche safety systems and methods of operation. One embodiment of the present invention relates to an avalanche safety system including an inflatable chamber, activation system, inflation system, a diagnostic system, and a harness. The inflatable chamber is a three-dimensionally, partially enclosed region having an inflated state and a compressed state. The inflated state may form a particular three dimensional shape configured to protect the user from impact and/or provide flotation during an avalanche. The activation system is configured to receive a user-triggered action to activate the system. The inflation system may include an air intake, battery, fan, and internal airway channel. The inflation system is configured to transmit ambient air into the inflatable chamber. The diagnostic system includes at least one sensor configured to measure a parameter corresponding to the inflation system and a display configured to visually, audibly, and/or tactilely display the parameter. The harness may be a backpack that enables a user to transport the system while engaging in activities that may be exposed to avalanche risk. The harness may include hip straps, shoulder straps, internal compartments, etc. Also, while embodiments are described in reference to an avalanche safety system it will be appreciated that the teachings of the present invention are applicable to other areas including but not limited to non-avalanche impact safety systems.

Figure 1:
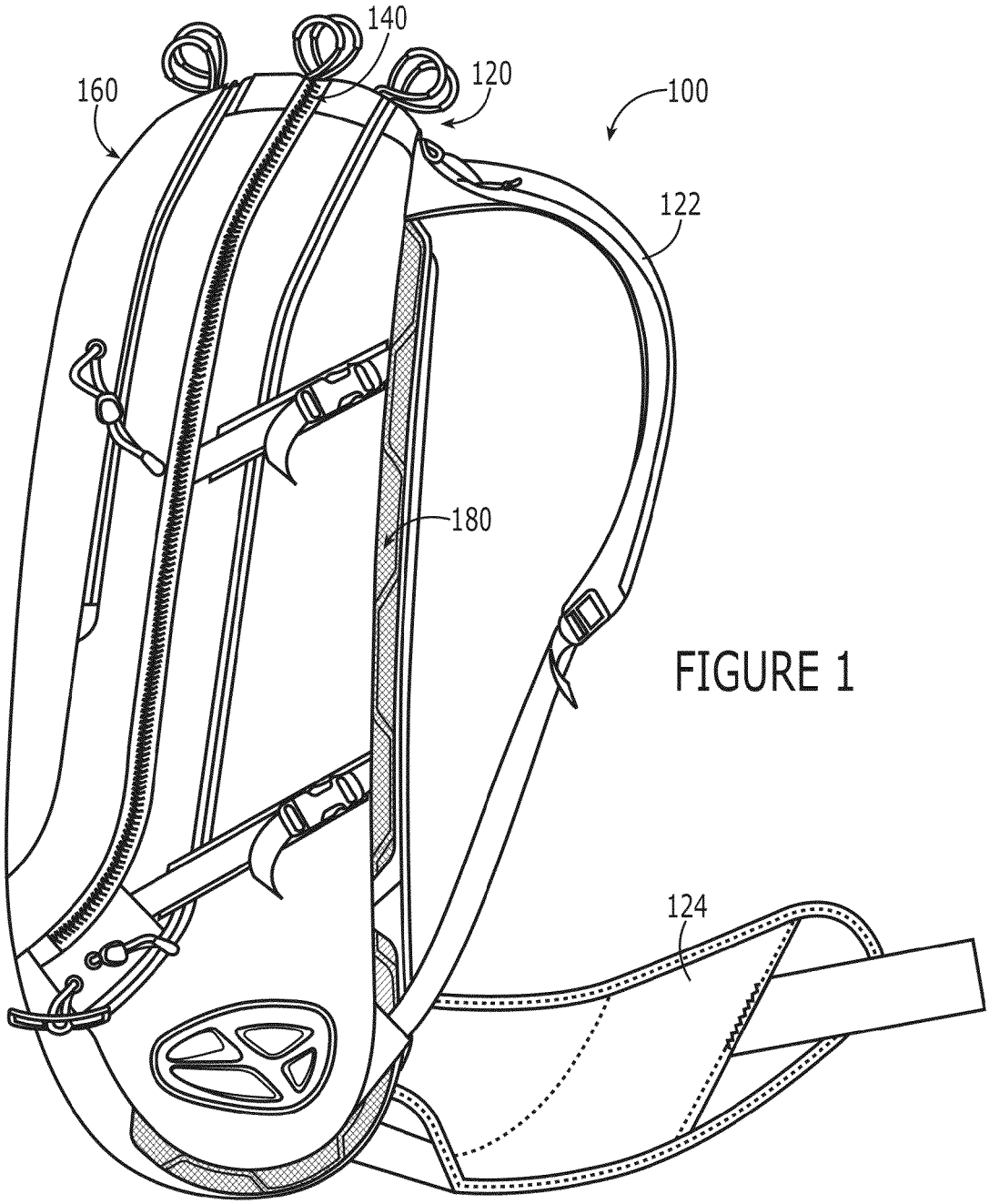
FIG. 1 illustrates a profile view of an avalanche safety system in accordance with embodiments of the present invention.

Reference is initially made to FIG. 1, which illustrates a profile view of an avalanche safety system, designated generally at 100. The illustrated system 100 includes an inflatable chamber 140, an inflation system 160, an activation system (not shown), and a harness 120. The inflatable chamber 140 is a three dimensional, inflatable, partially enclosed structure. In particular, the inflatable chamber 140 includes an inlet (not shown) and a particular inflated shape. The inflatable chamber 140 is illustrated in the compressed state in FIG. 1. The compressed state includes substantially expelling air from within the inflatable chamber and compressing the external surface of the inflatable chamber upon itself. FIG. 7C illustrates the inflated state of the inflatable chamber. The inflated state of the inflatable chamber includes expansion of the external surface away from the compressed state, substantially analogous to the inflation of a balloon. However, the inflatable chamber may include a particular three dimensional inflated shape such that upon inflation, the external surfaces are forced to form the shape. For example, the inflatable chamber may be configured to include multiple chambers, multiple regions, etc. FIG. 7C illustrates on embodiment of an inflated shape including a substantially pillow-shaped form with two horn members. It will be appreciated that various other shapes may be practiced in accordance with embodiments of the present invention. For example, the inflatable chamber 140 may be configured to wrap around the head and/or torso of the user.

Figure 2:
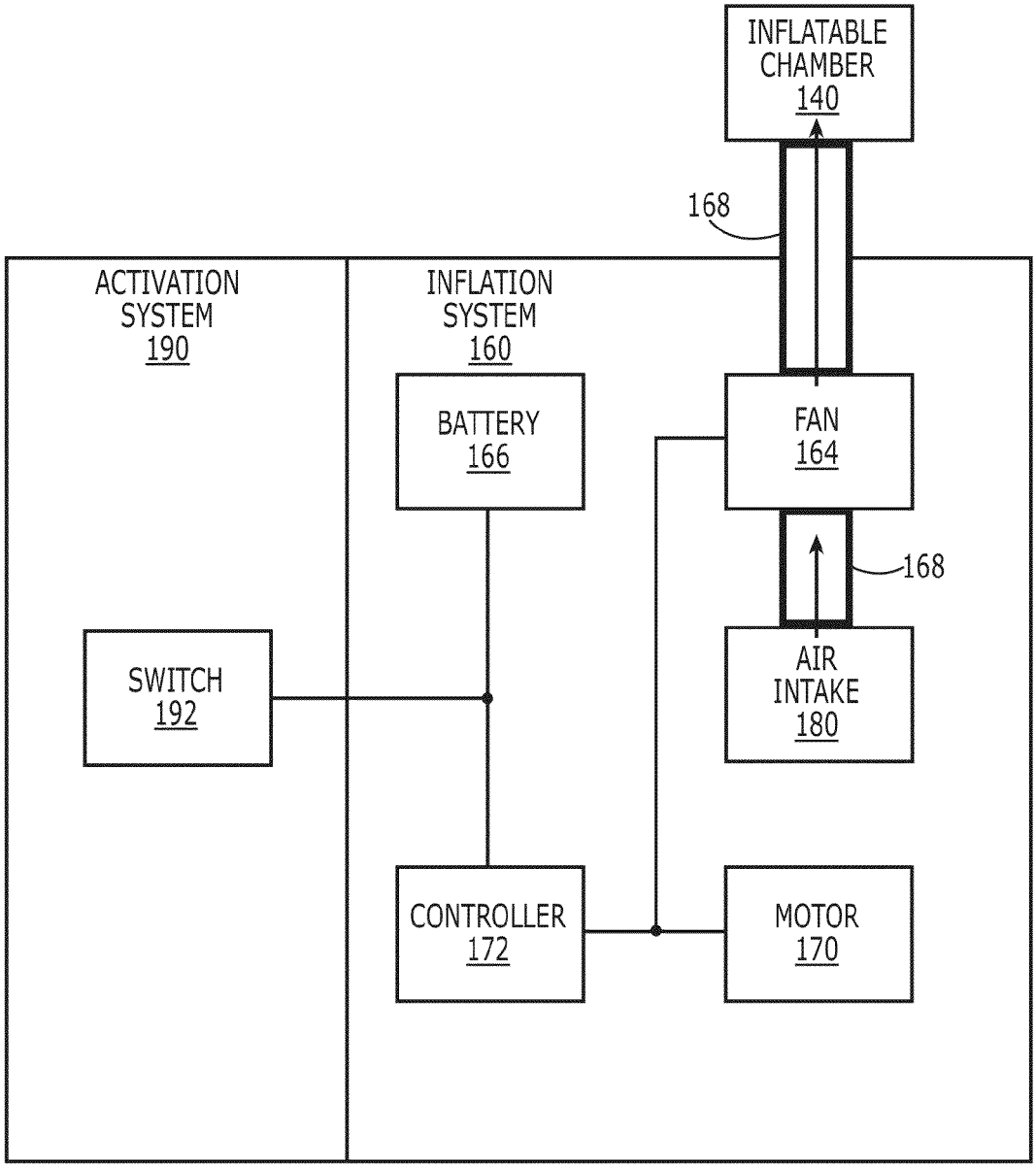
FIG. 2 illustrates a schematic of the avalanche safety system illustrated in FIG. 1.
Figure 3A:
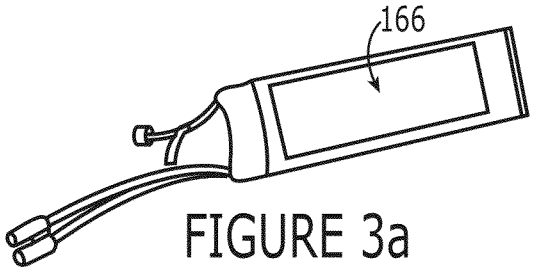
FIGS. 3A-D illustrate perspective views of inflation system components.
Figure 3B:
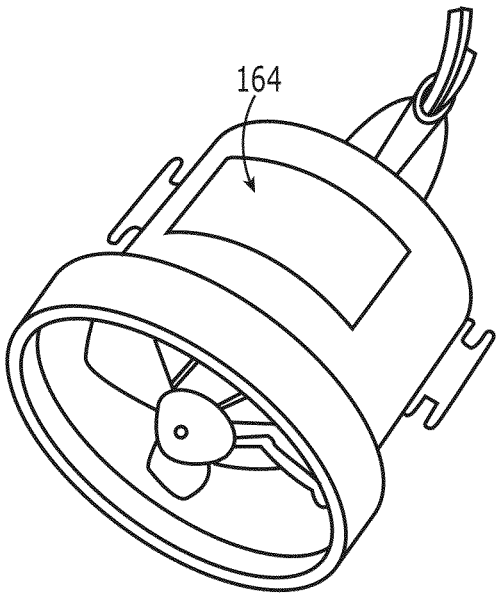
Figure 3C:
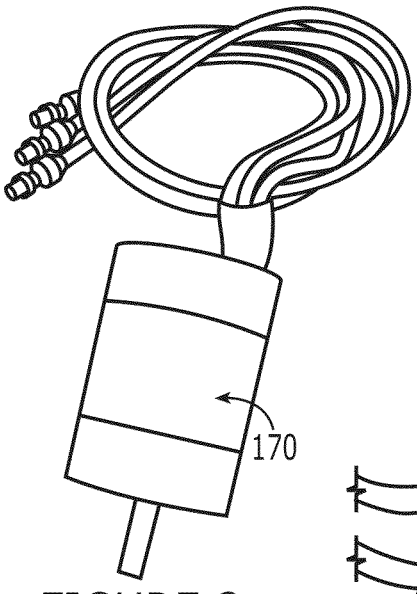
Figure 3D:
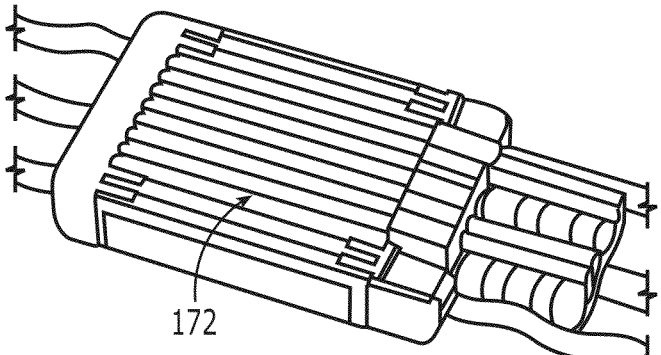

The inflation system 160 is configured to transition the inflatable chamber 140 from the compressed state to the inflated state. The inflation system 160 may further include an air intake 180, a fan 164, a battery 166, an internal airway channel 168, a motor 170, and a controller 172. The air intake 180 provides an inlet for receiving ambient air. The illustrated air intake 180 includes an elongated vent structure through which ambient air may flow. The air intake 180 is coupled to the internal airway channel 168 such that ambient air may be transmitted through the air intake 180 to the internal airway channel with minimal loss. The components and operation of the air intake will be described in more detail with reference to FIG. 5 below. The fan 164, battery 166, motor 170, and controller 172 are the electrical components of the inflation system. The electrical components of the inflation system 160 are electrically coupled to the activation system as illustrated in FIG. 2. The fan 164 is a rotational member configured to generate a vacuum force in a particular orientation upon rotation. The fan is oriented in the system 100 to generate the vacuum force such that ambient air is pulled into the inflatable chamber 140. It will be appreciated that fans in a variety of sizes may be used in accordance with embodiments of the present invention. The battery 166 may be any form of electrical storage device. The motor 170 converts electrical energy into mechanical rotation. The controller 172 may be any form of speed controller to facilitate particular inflation patterns such as a logarithmic increase in fan speed. The fan 164, battery 166, motor 170, and controller 172 are selected to correspond with one another to facilitate optimal inflation characteristics. For example, the size of fan 164 dictates the necessary speed and time required to inflate the inflatable chamber 140. The speed and time parameters thereby influence optimal selection of the remaining electrical components.

The activation system 190 is configured to activate the inflation system 160 to expand the inflatable chamber 140 to the inflated state. The activation system 190 is a user-input device configured to a user-triggered action intended to activate the system 100. The particular user-triggered action depends on the specific type of activation system components. For example, the activation system 190 may include some form of physical switch configured to receive a physical switching motion from the user to activate the system 100. The switch may be any type of switching mechanism including but not limited to a rip cord, push button, toggle, etc. The activation system 190 is electrically coupled to the inflation system 160 so as to engage the inflation system upon receipt of the user-triggered action. Alternatively or in addition, the activation system 190 may include other sensors designed to activate the system without a user-triggered action. In addition, the activation may include a deactivation switch. The deactivation switch may be used to deactivate the system in the event of an inadvertent activation.

Figure 6:
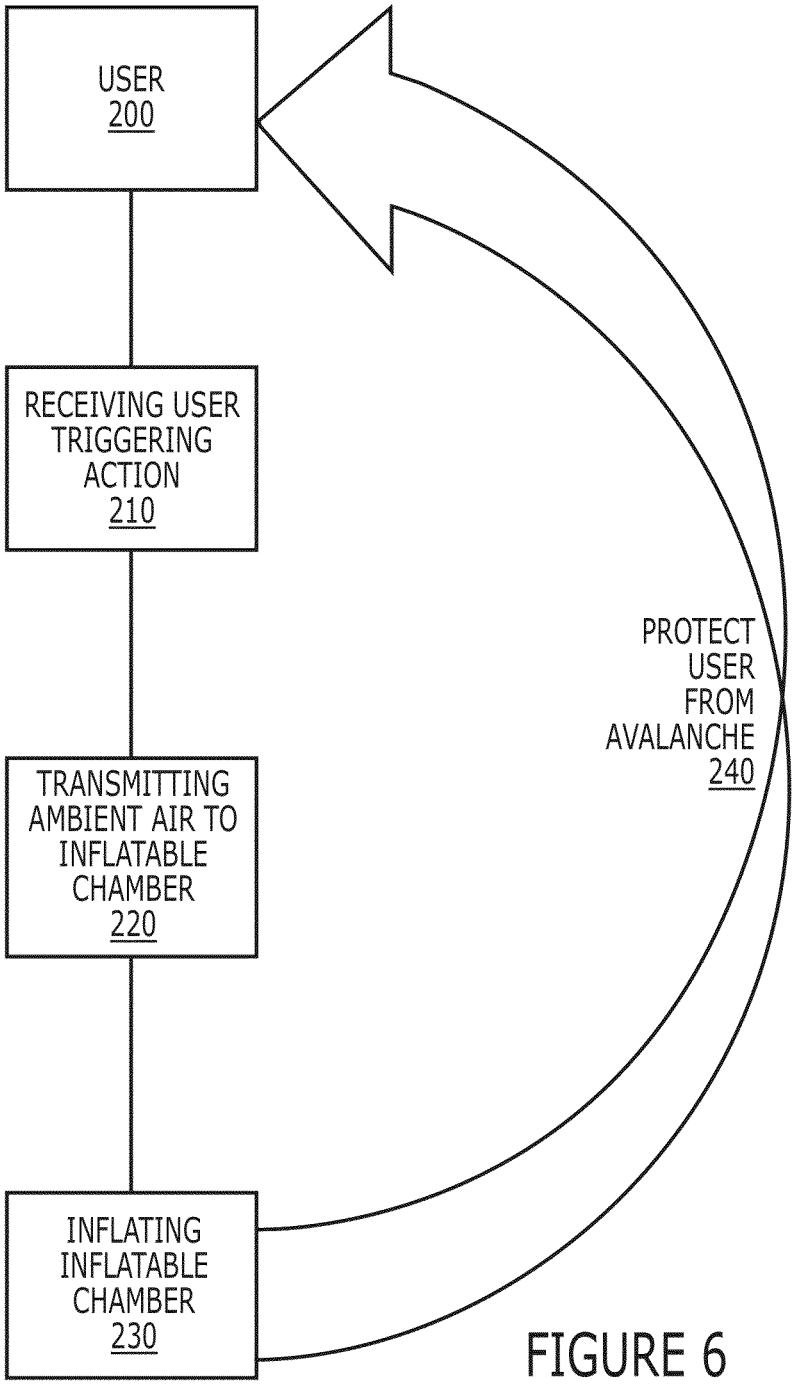
FIG. 6 illustrates a flow chart of a method in accordance with another embodiment of the present invention.
Figure 7A:
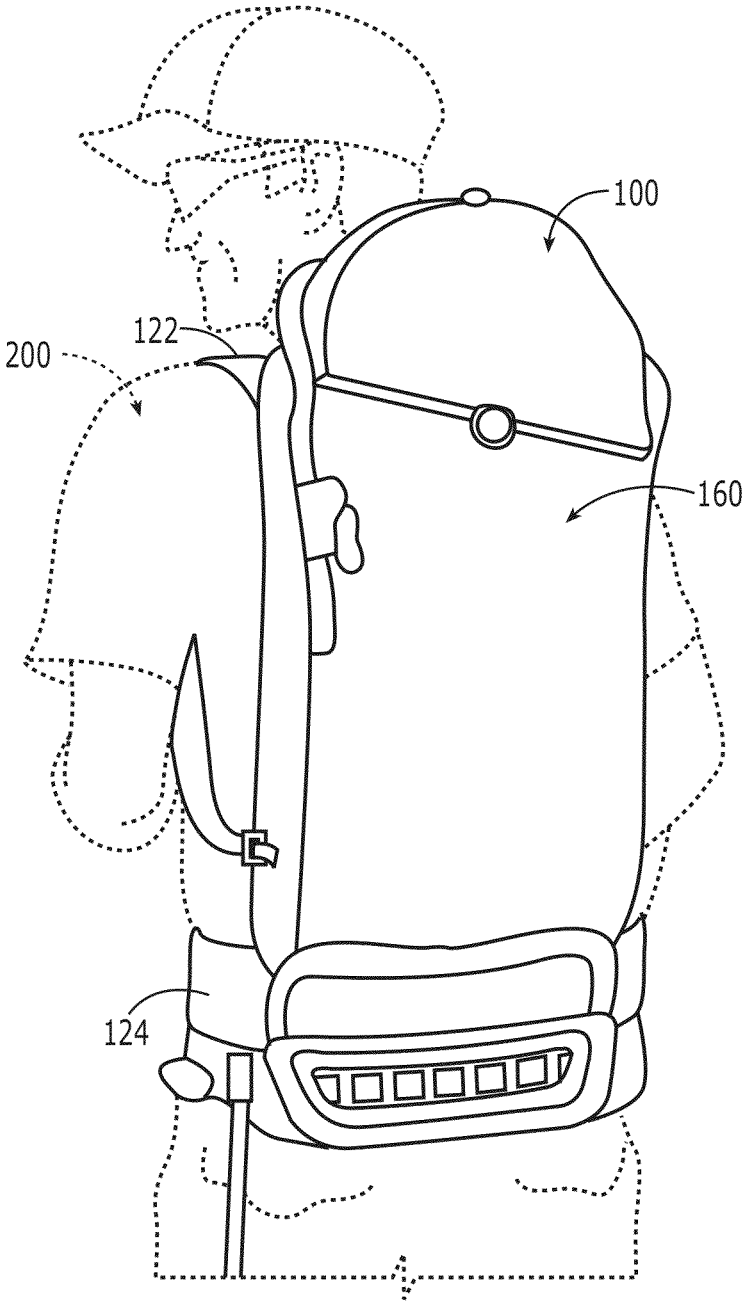
FIGS. 7A-7C illustrate an operational sequence of the system in FIG. 1 and the method of FIG. 6.
Figure 7B:
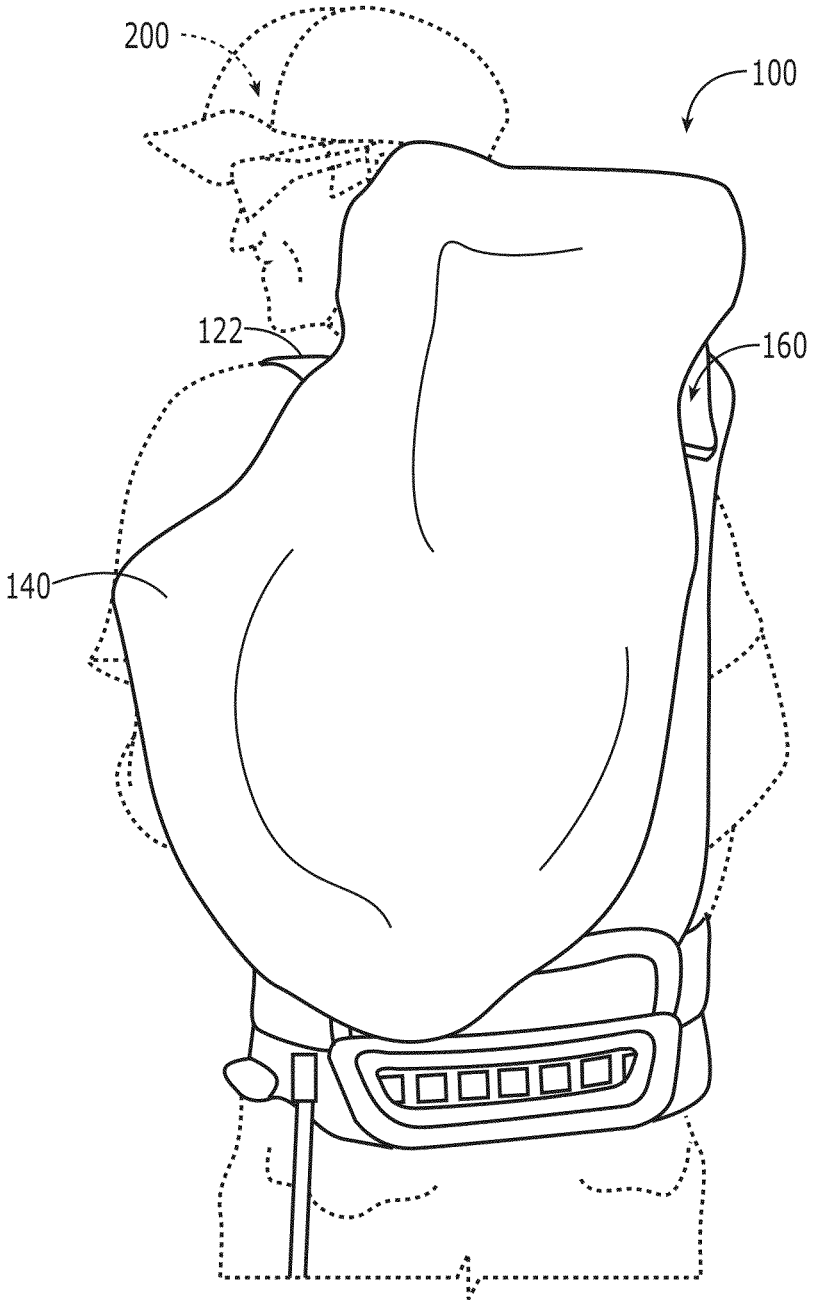
Figure 7C:
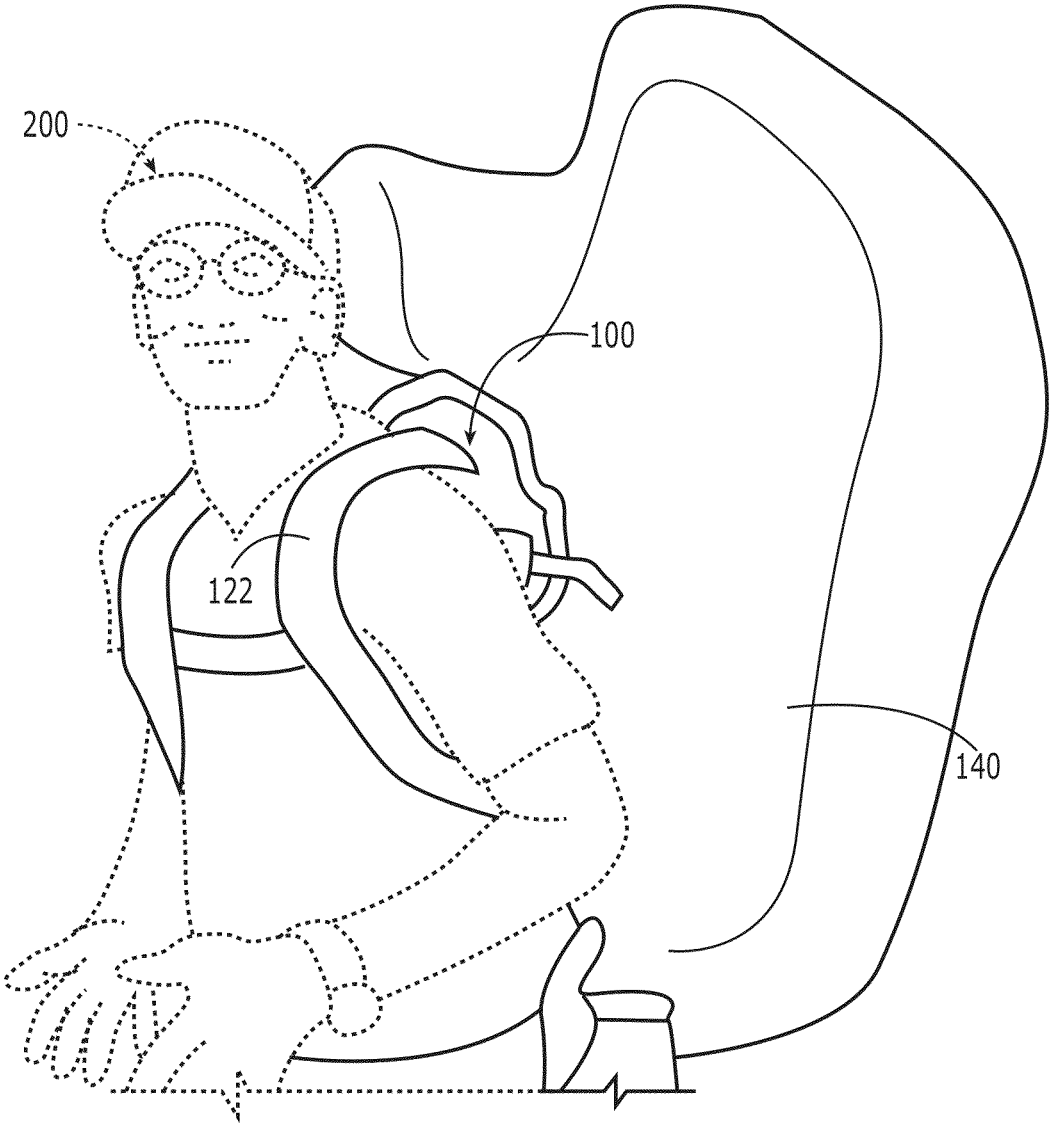

The harness 120 couples the system 100 to the user 200 as illustrated in FIGS. 7A-7C. The illustrated harness 120 in FIGS. 1-7 is a backpack-style unit, including a hip strap 124 and a shoulder strap 122. The backpack configuration provides an internal chamber separate from the inflatable chamber 140 within which the user may store items. The internal chamber is disposed between the user and the inflatable chamber 140 such that the inflatable chamber is distally disposed with respect to the remainder of the harness/backpack 120 and the user. Therefore, upon activation the inflatable chamber will be able to inflate without obstruction. The inflation system 160 is distal to the inflatable chamber 140 in the illustrated embodiment. The inflation system 160 may be disposed within a region configured to break away or articulate upon the inflation of the inflatable chamber 140, as illustrated in FIGS. 7A-C. The backpack or harness may further include various other straps and compartments in accordance with embodiments of the present invention. Alternatively, the harness may be any form of simple strapping apparatus configured to couple the system to the user.

Reference is next made to FIG. 2, which illustrates a schematic of the avalanche safety system illustrated in FIG. 1. The schematic diagram illustrates the operational relationship between various components of the system 100. The activation system 190 includes a switch 192. As discussed above, the activation system 190 is configured to receive a user-triggered action intended to activate the avalanche safety system 100 and inflate the inflatable chamber 140. The switch 192 is electrically coupled to the inflation system 160 between the battery 166 and the controller 172. As described above, the battery 166 stores electrical energy for use in inflating the inflatable chamber 140. The controller 172 is electrically coupled between the battery 166 and the motor 170. The controller 172 may provide a particular electrical inflation profile including modulation of current with respect to time. The motor 170 is electrically coupled to the controller 172 and fan 164 such that the modulated current from the controller 172 may be converted into mechanical rotation of the fan 164. The fan 164 is mechanically disposed between the air intake 180 and the inflatable chamber 140. In particular, an internal airway channel 168 connects the air intake 180, fan 164, and inflatable chamber 140 so as to minimize air loss. As discussed above, upon activation, the fan 164 generates a rotational force that creates a vacuum aligned with the illustrated arrows. The vacuum pulls external ambient air through the air intake 180, through the fan 164, and into the inflatable chamber 140.

Reference is next made to FIGS. 3A-D, which illustrate perspective views of the inflation system components. The battery 166 may be any type of electrical storage device including but not limited to a direct current battery of the type illustrated. The fan 164 may be a circular fan that facilitates engagement with the internal airway channel 168. The motor 170 may be any type of motor 170 configured to correspond to the battery 166 and controller 172 parameters. Likewise, the controller 172 may be configured according the inflation objectives for the inflatable chamber 140.

Figure 4:
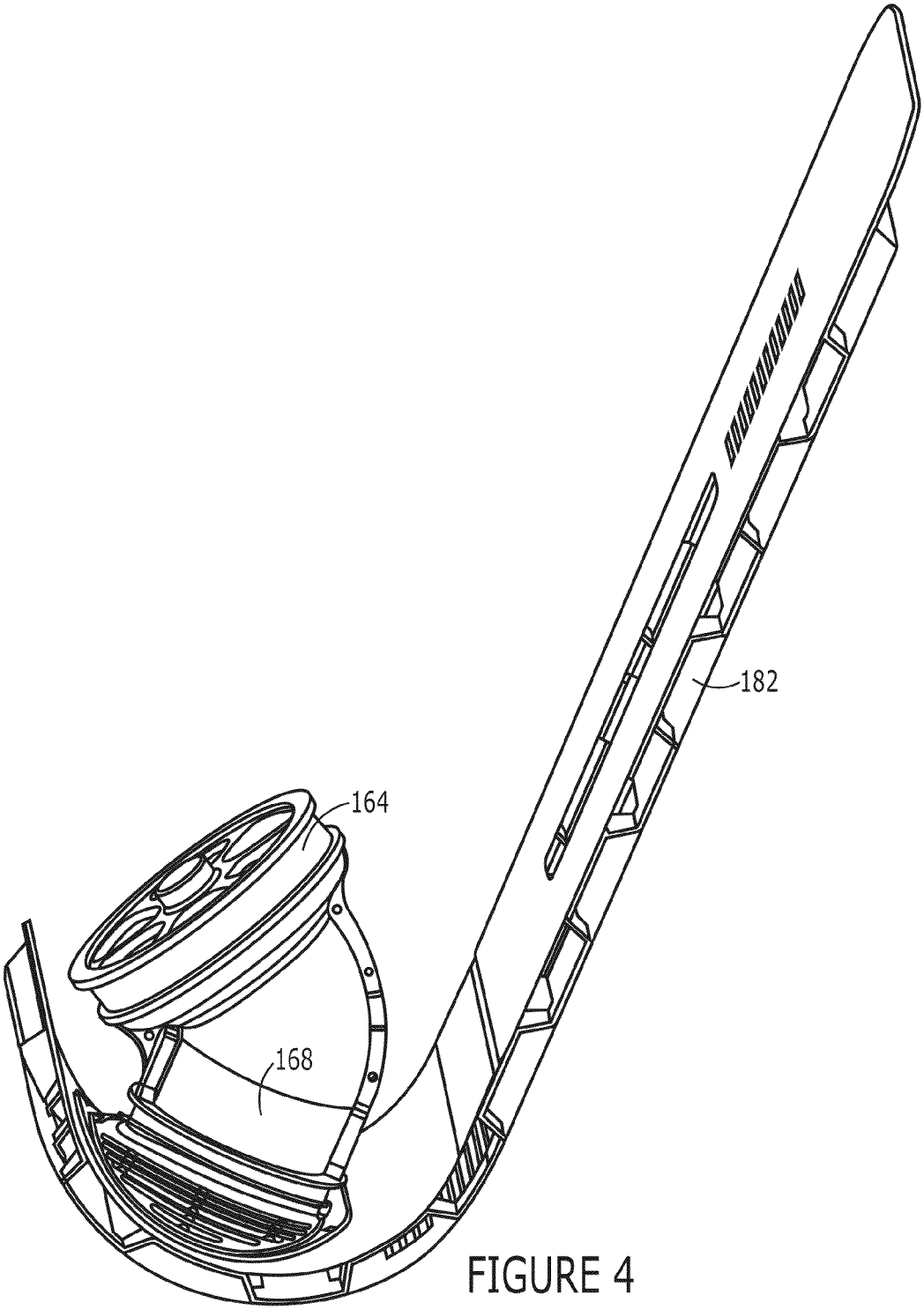
FIG. 4 illustrates a perspective view of the air intake frame, internal airway channel, and fan.

Reference is next made to FIG. 4, which illustrates a perspective view of the air intake frame 182, internal airway channel 168, and fan 164. The air intake frame 182 is part of the air intake 180. Various other air intakes may also be incorporated including but not limited to the sides, bottom and front of the system 100. Increasing the number of air intake regions increases reliability of the air intake system during operation. The air intake frame 182 is a partially rigid member with a lateral vent structure as illustrated. In particular, the lateral vent structure includes a channel to the internal airway channel 168. Therefore, air/gas transmitted through the lateral vents may be routed to the internal airway channel 168. The air intake frame 182 includes rigid internal structure members in order to maintain the channel. The illustrated internal airway channel 168 is a cylindrical member coupled between the air intake frame 182 and the fan 164. The internal airway channel 168 substantially encloses the coupling so as to minimize air leakage between the air intake frame 182 and the fan 164. The fan 164 is coupled to the internal airway channel 164. The inflatable chamber 140 (not shown in FIG. 4) is coupled to the fan 164 either directly or via another internal airway channel member (not shown).

Figure 5:
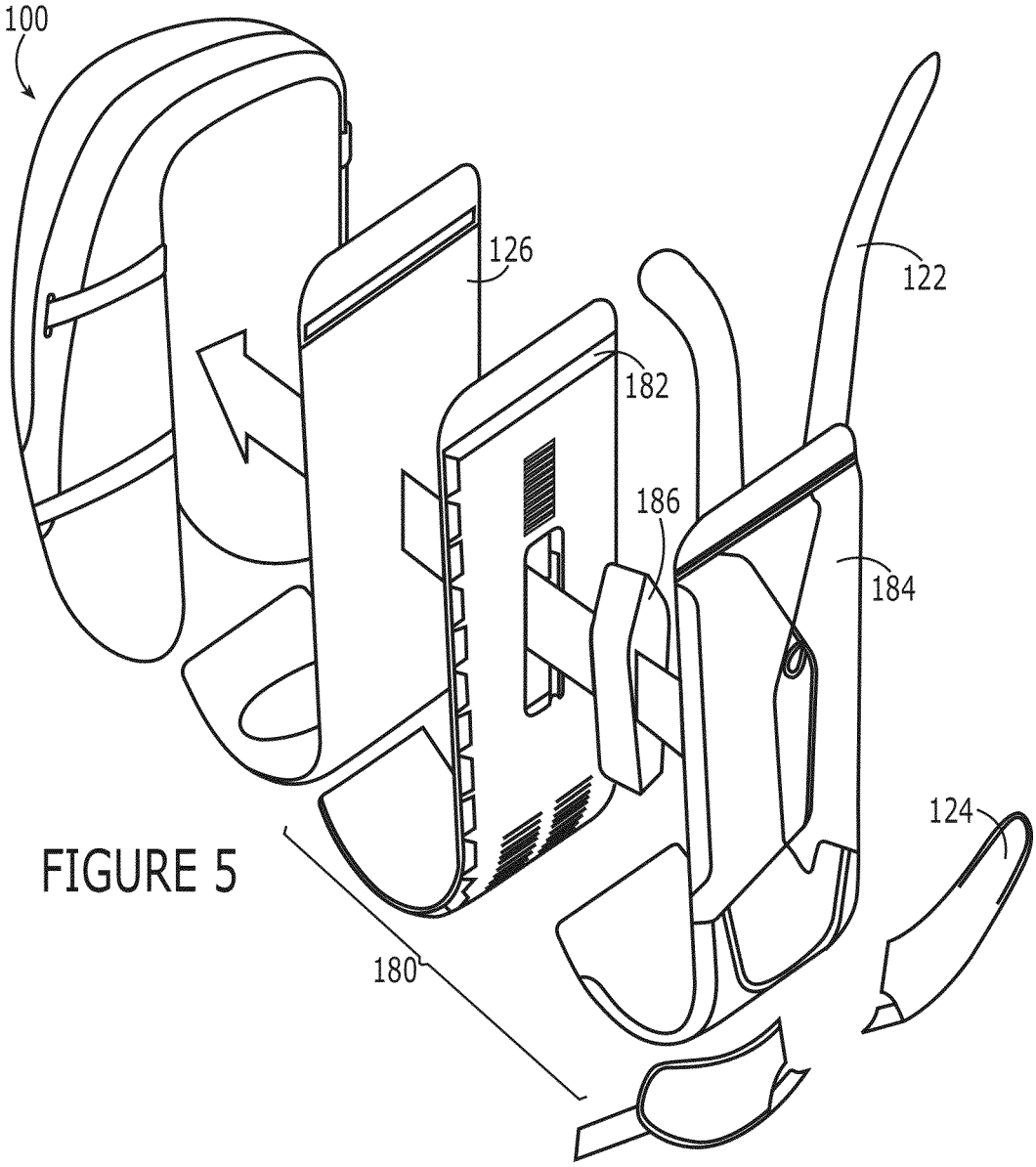
FIG. 5 illustrates an exploded view of the air intake with respect to the remainder of the avalanche safety system.

Reference is next made to FIG. 5, which illustrates an exploded view of the air intake 180 with respect to the remainder of the avalanche safety system. The air intake 180 includes the air intake frame 182 (illustrated in FIG. 4), a battery compartment 186, and a cover 184. The battery compartment 186 is configured to be disposed within the air intake frame 182. The positioning of the battery compartment 186 and the battery (not shown) with respect to the user is important because of the relative weight of most batteries. Therefore, positioning the battery 164 in a central region enables the shoulder 122 and hip straps 124 of the backpack (harness 120) to efficiently support the battery during operation. In addition, the battery 164 must be kept above a certain temperature for proper operation, and therefore positioning adjacent to the user ensures some amount of thermal insulation from the ambient temperature. The cover 184 includes padded regions and mesh regions. The padded regions facilitate user comfort and are disposed between the user and the air intake frame 182. The mesh regions are oriented to align with the lateral venting structure of the air intake frame 182. Therefore, ambient air may transmit through the mesh regions and into the air intake frame 182 as discussed above. Likewise, the mesh regions prevent debris from obstructing the vent structure of the air intake frame 182.

FIG. 5 further illustrates a frame 126 member of the backpack or harness 120. The frame 126 may include a rigid support region for further supporting the system with respect to the user. The exploded view illustrates the positioning of the air intake 180 and the frame 126 with respect to the remainder of the system 100. The hip/waist straps 124 and the shoulder straps 122 are also illustrated in the exploded view for positional reference.

Reference is next made to FIG. 6, which illustrates a flow chart of a method in accordance with another embodiment of the present invention. The method for inflating an inflatable chamber within an avalanche safety system comprises a plurality of acts. The illustrated method may be performed using the avalanche safety system 100 described above or in correlation with an alternative avalanche safety system. The method includes receiving a user-triggered action intended to activate the avalanche safety system, 210. The user-triggered action may include receiving a physical operation or gesture such as pulling a ripcord or depressing a button. Alternatively, the act of receiving a user-triggered action may include receiving a non-physical operation. Upon receipt of the user-triggered action, the method transmits ambient air to the inflatable chamber, 220. The act of transmitting ambient air to the inflatable chamber may include generating a vacuum that transmits ambient air through an internal airway channel to the inflatable chamber. The act of generating a vacuum may include using a fan and/or other electrical components. The inflatable chamber is inflated, act 230. The act of inflating the inflatable chamber may include inflation entirely with ambient air. The act of inflating the inflatable chamber may also include forming a particular three dimensional shape and internal pressure of the inflatable chamber. The inflation of the inflatable chamber thereby protects the user from an avalanche, act 240. The act of protecting the user from an avalanche may include cushioning the user from impact during the avalanche debris, elevating the user above the avalanche, and/or providing a breathing receptacle of ambient air.

Reference is next made to FIGS. 7A-7C, which illustrate an operational sequence of the system in FIG. 1 and the method of FIG. 6. FIG. 7A illustrates a user 200 with an avalanche safety system 100 in accordance with embodiments of the present invention. In particular, the user 200 is wearing the system 100 via a backpack harness structure including a set of hip/waist straps 124 and shoulder straps 122. The system includes an activation system 190 (not shown), inflation system 160 and inflatable chamber 140 as described above. FIG. 7A illustrates the inflatable chamber 140 in the compressed state so as to be contained within a region of the backpack. In addition, the system illustrated in FIG. 7A has not been activated and therefore the user has not performed any type of user-triggered action upon the activation system 190. Prior to FIG. 7B, the user performs a particular user-triggered action such as pulling a ripcord or pressing a button to activate the system 100. As described above, the activation system includes an electrical coupling that activates the components of the inflation system 160. For example, activation of the activation system 190 may include switching a switch so as to remove electrical resistance between a battery and other electrical components. Upon activation, the inflation system 160 transmits ambient air to the inflatable chamber 140. FIG. 7B represents the transition from the compressed state to the inflated state of the inflatable chamber 140. The inflatable chamber 140 is partially filled with ambient air directed through an air intake 180, internal airway channel 168, and fan 164. A controller 172 may be used to inflate the inflatable chamber 140 according to a particular inflation profile. The inflation system 160 automatically translates in response to the inflation of the inflatable chamber 140. In the illustrated embodiment, the inflation system 160 is disposed within a region that is translating to the right as the inflatable chamber 140 is expanding. The inflation system 160 may be housed within a region with a releasable coupling (such as VELCRO) to the remainder of the system, thereby enabling automatic displacement in response to inflation. FIG. 7C illustrates complete transition to the inflated state of the inflatable chamber 140. The inflatable chamber 140 thereby forms a particular three dimensional shape and has a particular pressure. The particular three dimensional shape and pressure of the inflatable chamber are specifically selected to protect the user 200 from impact and provide flotation during an avalanche. Various alternative shapes and pressures may be utilized in accordance with embodiments of the present invention. The pressure within the inflatable chamber may be maintained for a particular time using a one way valve that seals the inlet from transmitting air out from the inflatable chamber 140. Likewise, the controller 172 may be configured to shut off and/or restart the fan 164 after a certain amount of time corresponding to complete inflation of the inflatable chamber 140.

Figure 8:
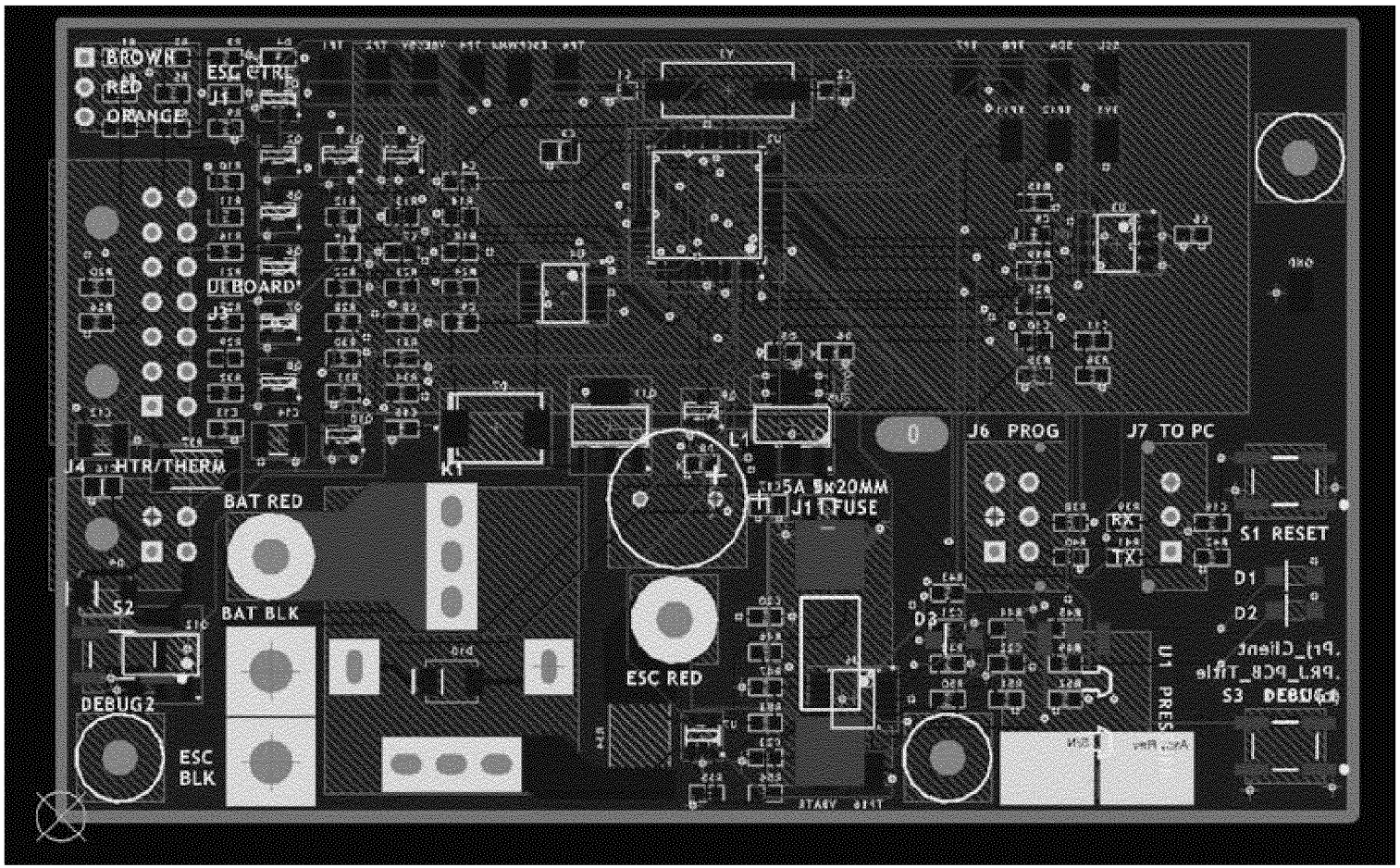
FIG. 8 illustrates a schematic of one embodiment of a printed circuit board for embodiments of the avalanche safety system, including a diagnostic system.

Reference is next made to FIG. 8, which illustrates a schematic of one embodiment of a printed circuit board, designated generally at 400. The printed circuit board may include electrical components of the inflation system, activation system, and diagnostic system. The printed circuit board 400 may include various resistors, capacitors, etc. configured to be electrically coupled between the fan and battery of the inflation system. The printed circuit board 400 may also include various resistors, transistors, integrated circuits, capacitors, switches, etc. electrically coupled between the inflation system and a user input device of the activation system. The printed circuit 400 may also include sensors and other electrical components coupled to both the inflation system/chamber and a display. The diagnostic system will be described in more detail with reference to the figures below.

Figure 9:
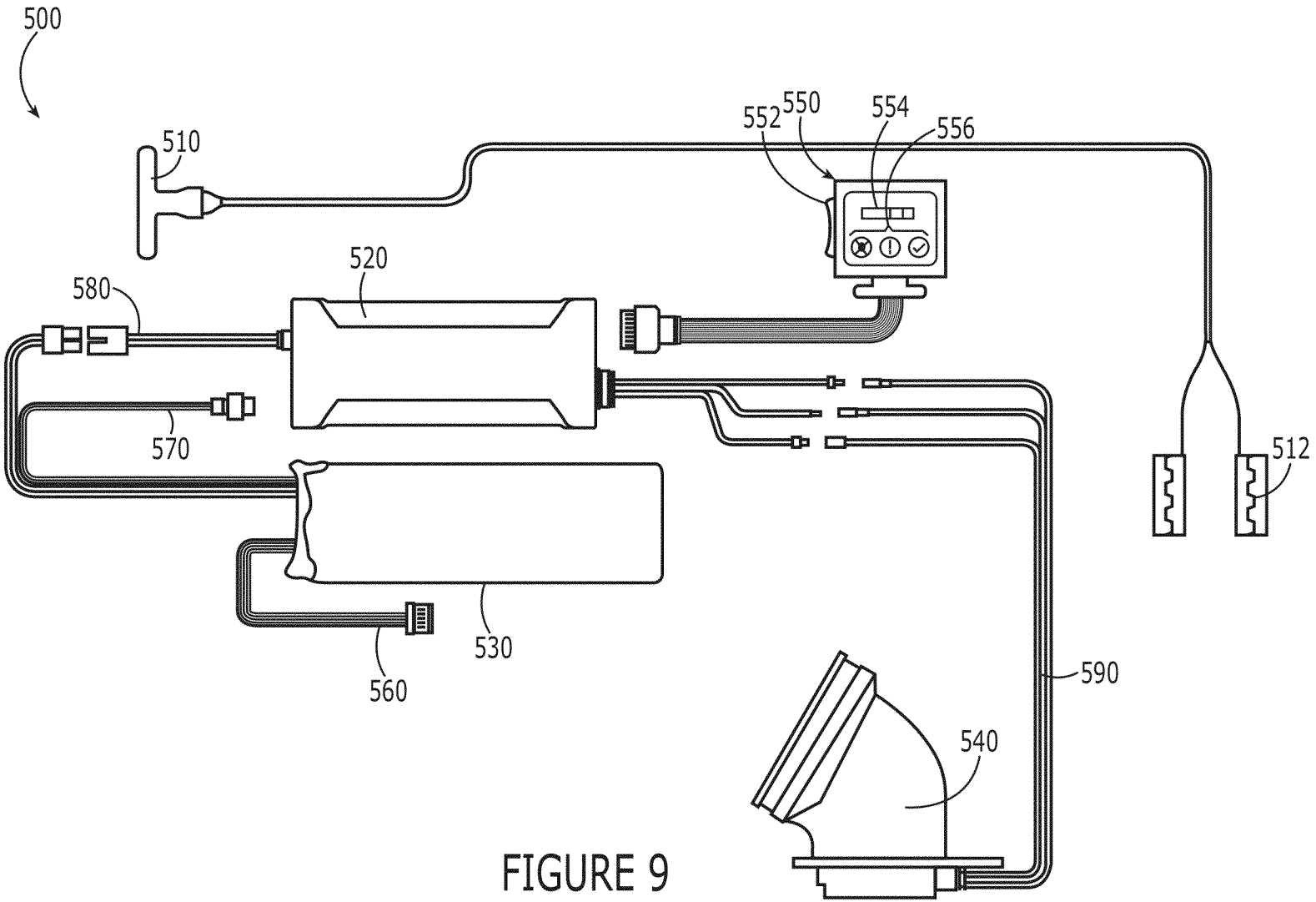
FIG. 9 illustrates a schematic component diagram of the electrical components of one embodiment of an avalanche safety system, including a diagnostic system with a diagnostic display.

Reference is next made to FIG. 9, which illustrates a schematic component diagram of electrical components of one embodiment of an avalanche safety system including a diagnostic system, designated generally at 500. The illustrated electrical components 500 of the avalanche safety system perform particular functions which are categorized as independent systems, including an inflation system, an activation system, and a diagnostic system. As described above, the inflation system includes the fan 540 and battery 530 to inflate the inflatable chamber from the compressed state to the inflated state. The activation system includes a user input device 510 and a controller 520 to activate the inflation system in response to receiving a user triggering action. The diagnostic system includes a sensor 570 to measure a parameter corresponding to the inflation system and a display 550 to visually, audibly, and/or tactilely display the parameter to the user. The electrical components of each system may be intercoupled to provide the particular functionality.

The illustrated inflation system components may include a fan 540, battery 530, and controller 520. The fan 540 may be any electrical fan configured to rotate a blade in response to an electrical current. The rate at which the fan 540 rotates the blade corresponds to the battery 530 and controller 520. The battery 530 may be a direct current battery with at least 500 mAh capacity. The illustrated battery 530 is electrically coupled to the fan 540 via the controller 520. The battery 530 may also include a charging coupler 560 to enable a user to recharge the battery 530. The controller 520 may include electrical components pertaining to the inflation system, such as resistors, capacitors, etc.

The illustrated activation system components may include the user input device 510, and controller 520. The illustrated user input device 510 is a mechanical rip-cord with a set of electrical couplers 512. The mechanical rip-cord receives the user triggering action of pulling the rip-cord to indicate the user intends to activate the inflation system and inflate the inflatable chamber. The electrical couplers 512 are electrically coupled to the controller 520 (not shown). The electrical couplers 512 may be configured to electrically decouple from corresponding male couplers coupled to the controller 520. The controller 520 therefore receives the user triggering action via the electrical decoupling of the electrical couplers 512 from the pulling action of the user. The illustrated configuration with electrical couplers 512 corresponds to a mechanical activation via a user pulling type triggering action. Alternatively, the system may incorporate an entirely electrical activation such as a button type user triggering action. The controller 520 includes logic components including but not limited to processors, integrated circuits, etc. to selectively activate the inflation system (i.e. electrically couple the battery 530 to the fan 540) in response to the user triggering action. The controller 520 may also include additional algorithms corresponding to the inflation system including periodic testing, cycling, reinflation, deflation, etc. The illustrated activation system further includes a power switch 552 disposed on the display 550 of the diagnostic system. Various other types of electrical switches including but not limited to mechanical, pushbutton, and/or magnetic switches may be used in accordance with embodiments of the present invention. The activation system may alternatively include a user input device disposed substantially adjacent to the display of the diagnostic system such as the embodiment illustrated in FIG. 10.

The illustrated diagnostic system components may include the controller 520, battery temperature sensor 570, and display 550. The controller 520 may include further logic components, including but not limited to processors, integrated circuits, etc. in order to measure at least one parameter of the inflation system. The illustrated battery includes a temperature sensor 570 which is electrically coupled to the controller 520 to enable the controller to measure the battery temperature. The controller's 520 logic components may monitor whether the battery temperature sensor indicates that the battery 530 is above a particular temperature corresponding to the minimum temperature necessary to provide sufficient power to the fan 540 to inflate the inflatable chamber from the compressed state to the inflated state. The particular minimum temperature may be predetermined or calculated via an automatic testing algorithm. The diagnostic system may include various other sensors related to the inflation system or the inflatable chamber. For example, the diagnostic system may also measure the battery power to determine if sufficient power is available to power the fan 540 to inflate the inflatable chamber from the compressed state to the inflated state. The diagnostic system may also include a sensor to measure if the inflatable chamber is in the compressed state and thereby capable of inflation. The controller 520 may include various algorithms pertaining to each sensor to provide feedback to the user and/or automatically perform functions. The display 550 is electrically coupled to the controller 520 and configured to display the parameter(s) measured by the controller 520. The illustrated display 550 includes a power button 552, a visual quantity indicator 554, and visual color indicator 556. The visual quantity indicator 554 may display a bar with a length corresponding to the measured power of the battery. The length of the bar may be configured such that a zero length corresponds to the battery power being under the minimum power necessary to power the fan 540 so as to inflate the inflatable chamber from the compressed state to the inflated state. Alternatively, the length of the bar may correspond to the temperature of the battery. The visual color indicator system 556 includes red, yellow, and green indicators. The illumination of the corresponding colored indicators may correspond to the temperature of the battery 530 measured by the controller 520 and temperature sensor 570. For example, the yellow and green indicators may indicate the battery 530 is above the minimum temperature to power the fan 530 to inflate the inflatable chamber from the compressed state to the inflated state. In addition, the visual color indicator may simultaneously or independently correspond to a measurement of whether the inflatable chamber is in the compressed state and capable of inflation. Alternatively or in addition, the visual color indicator may correspond to the power of the battery. The power switch 552 may receive a user input to turn on and off the diagnostic system for purposes of conserving battery 530 power.

Figure 10:
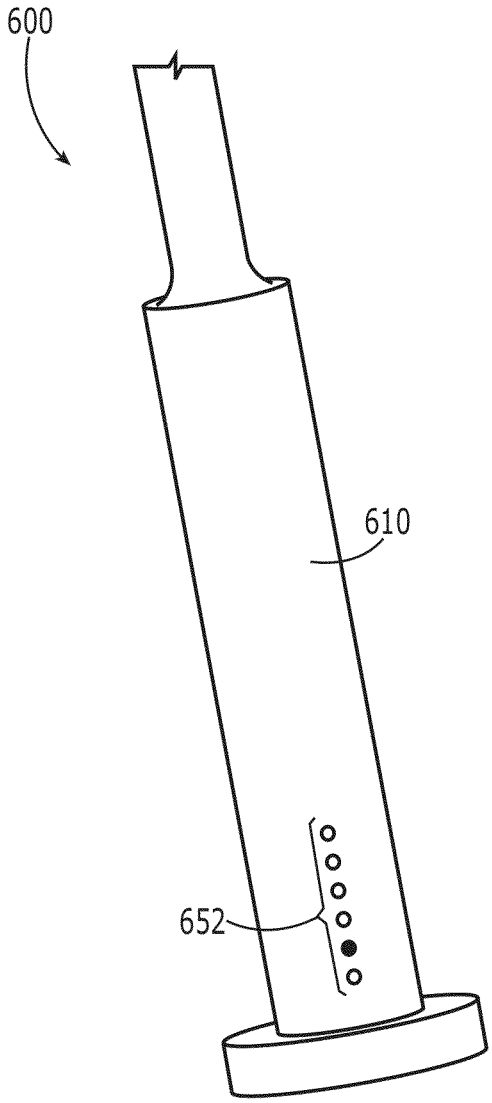
FIG. 10 illustrates a perspective view of a diagnostic display in accordance with embodiments of the present invention.

Reference is next made to FIG. 10, which illustrates a perspective view of a diagnostic display and user input device, designated generally at 600. As described above, the activation system includes a user input device 610 designed to receive a user triggering action from the user. The illustrated user input device 610 is a rip-cord type handle configured to transmit a mechanical pulling force from the user to an electrical signal, indicating that the user intends to activate the inflation system and inflate the inflatable chamber from the compressed state to the inflated state. The illustrated embodiment of the user input device 610 also includes the display 652 of the diagnostic system. Therefore, the user input device 610 and the display 652 are substantially proximal to one another, or otherwise correspondingly positioned. The illustrated display 652 includes a plurality of LED indicators. The LED indicators may visually display both colors and/or a series to indicate a quantity. Therefore, the LED indicators may display multiple measurements or parameters pertaining to the inflation system and/or the inflatable chamber. Various other types of displays may be utilized in accordance with embodiments of the present invention. For example, various audible displays may display information via pitch, tone, or volume. Likewise, various tactile displays may create various tactile modifications corresponding to the parameter or measurements.

Additional non-illustrated embodiments of the present invention may include transmitting one or more parameters to a wireless computing device. For example, the display and/or the user input device may be configured to send and receive data via a wireless protocol such as Bluetooth, Zigby, wireless USB, etc.

It should be noted that various alternative system designs may be practiced in accordance with the present invention, including one or more portions or concepts of the embodiment illustrated in FIG. 1 or described above. Various other embodiments have been contemplated, including combinations in whole or in part of the embodiments described above.

What is claimed is:

1. An inflatable avalanche safety system comprising:

an inflatable chamber including a compressed state and an inflated state, wherein the inflated state forms a pressurized three dimensional region in proximity to a user;

an inflation system configured to inflate the inflatable chamber from the compressed state to the inflated state;

an activation system configured to activate the inflation system;

a diagnostic system including at least one sensor configured to measure a parameter corresponding to the inflation system and a display configured to display the parameter, wherein the at least one sensor includes a battery sensor configured to measure if the battery is capable of providing a minimum voltage for the inflation system to inflate the inflatable chamber from the compressed state to the inflated state; and a harness configured to support the inflatable chamber, activation system, and inflation system in proximity to the user.

2. The system of claim 1, wherein the inflation system is configured to inflate the inflatable chamber with ambient air and a fan.

3. The system of claim 1, wherein the diagnostic system includes at least one sensor configured to measure a parameter corresponding to if the inflatable chamber is in the compressed state.

4. The system of claim 1, wherein the battery sensor includes a temperature sensor and a voltage sensor.

5. The system of claim 1, wherein the display is coupled to the harness so as to be proximal to an anterior region of the user.

6. The system of claim 1, wherein the display includes at least one of visual, audible, and tactile quantifying the parameter in at least two independent formats including at least one of pitch, tone, volume, shape, color, length, and Boolean.

7. The system of claim 1, wherein the activation system includes a user input device configured to receive a user triggering action.

8. The system of claim 7, wherein the display is disposed substantially adjacent to the user input device.

9. The system of claim 7, wherein the user input device is mechanical rip cord configured to transmit a force to activate the inflation system.

10. The system of claim 7, wherein the user input device is an electrical switch configured to electrically activate the inflation system.

11. The system of claim 7, wherein the user input device is coupled to the harness so as to be proximal to an anterior region of the user.

12. An inflatable avalanche safety system comprising:

an inflatable chamber including a compressed state and an inflated state, wherein the inflated state forms a pressurized three dimensional region in proximity to a user;

an inflation system configured to inflate the inflatable chamber from the compressed state to the inflated state;

an activation system configured to activate the inflation system;

a diagnostic system including at least one sensor configured to measure a parameter corresponding to the inflation system and a display configured to display the parameter, wherein the at least one sensor includes a battery sensor configured to measure if the battery is capable of providing a minimum voltage for the inflation system to inflate the inflatable chamber from the compressed state to the inflated state, and wherein the activation system includes a user input device configured to receive a user triggering action, and wherein the display is disposed substantially adjacent to the user input device; and a harness configured to support the inflatable chamber, activation system, and inflation system in proximity to the user.

13. A method for diagnosing the capability of an inflatable avalanche safety device to a user comprising the acts of:

providing an inflatable avalanche safety system comprising:

an inflatable chamber including a compressed state and an inflated state, wherein the inflated state forms a pressurized three dimensional region in proximity to a user;

an inflation system configured to inflate the inflatable chamber from the compressed state to the inflated state;

an activation system configured to activate the inflation system;

a harness configured to support the inflatable chamber, activation system, and inflation system in proximity to the user;

measuring a parameter corresponding to the inflation system, including measuring if the capacity of the battery is over a particular level corresponding to the minimum battery capacity for the inflation system to inflate the inflatable chamber from the compressed state to the inflated state; and displaying the measured parameter to the user in a visual format.

14. The method of claim 13, wherein the act of measuring a parameter corresponding to the inflation system includes measuring if the temperature of the battery is over a particular level corresponding to the minimum battery temperature for the inflation system to inflate the inflatable chamber from the compressed state to the inflated state.

15. The method of claim 13, wherein the act of displaying the measured parameter to the user in a visual format includes displaying the measured parameter in a plurality of independent visual formats.

16. The method of claim 13 further includes measuring a parameter corresponding to the inflatable chamber.

17. The method of claim 16, wherein the act of measuring a parameter corresponding to the inflatable chamber further includes measuring if the inflatable chamber is in the compressed state.

18. The method of claim 13, wherein the act of measuring a parameter corresponding to the inflation system includes measuring a plurality of parameters corresponding to the necessary parameters to determine if the inflation system is capable to inflate the inflatable chamber from the compressed state to the inflated state.

* * * * *